US011725500B2

(12) United States Patent
Roussel et al.

(10) Patent No.: US 11,725,500 B2
(45) **Date of Patent: *Aug. 15, 2023**

(54) METHOD FOR DETERMINING HYDRAULIC FRACTURE ORIENTATION AND DIMENSION

(71) Applicant: ConocoPhillips Company, Houston, TX (US)

(72) Inventors: Nicolas Patrick Roussel, Houston, TX (US); Horacio Florez, Houston, TX (US); Adolfo Antonio Rodriguez, Houston, TX (US); Samarth Agrawal, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/851,713

(22) Filed: Jun. 28, 2022

(65) Prior Publication Data

US 2022/0325618 A1 Oct. 13, 2022

Related U.S. Application Data

(60) Continuation of application No. 17/191,280, filed on Mar. 3, 2021, now Pat. No. 11,371,339, which is a (Continued)

(51) Int. Cl.
*E21B 43/26* (2006.01)
*E21B 47/06* (2012.01)

(52) U.S. Cl.
CPC ..... *E21B 47/06* (2013.01); *E21B 43/26* (2013.01)

(58) Field of Classification Search
CPC ..... E21B 43/26; E21B 43/267; E21B 49/00; E21B 49/006; E21B 49/008; E21B 47/06; G01V 2210/646; G01V 2210/66
See application file for complete search history.

(56) References Cited

U.S. PATENT DOCUMENTS 3,933,205 A 1/1976 Kiel
4,802,144 A 1/1989 Holzhausen et al.
(Continued)

FOREIGN PATENT DOCUMENTS

EP 2163724 A2 3/2010
WO WO-2011022012 A1 2/2011
(Continued)

OTHER PUBLICATIONS

Daneshy A., et al., "Fracture Shadowing: A Direct Method of Determining of the Reach and Propagation Pattern of Hydraulic Fractures in Horizontal Wells," Society of Petroleum Engineers, Hydraulic Fracturing Technical Conference, Woodlands, TX, USA, Feb. 2012, 9 Pages.
(Continued)

*Primary Examiner* — Kipp C Wallace
(74) *Attorney, Agent, or Firm* — ConocoPhillips Company

(57) ABSTRACT

Method for characterizing subterranean formation is described. One method includes inducing one or more fractures in a portion of the subterranean formation. Determining a poroelastic pressure response due to the inducing of the one or more fractures. The poroelastic pressure response is measured by a sensor that is in at least partial hydraulic isolation with the portion of the subterranean formation. Monitoring closure of the one or more fractures via the poroelastic pressure response.

20 Claims, 10 Drawing Sheets

Related U.S. Application Data continuation of application No. 15/924,783, filed on Mar. 19, 2018, now Pat. No. 10,954,774, which is a division of application No. 14/575,176, filed on Dec. 18, 2014, now Pat. No. 9,988,895.

(60) Provisional application No. 61/917,659, filed on Dec. 18, 2013.

(56) References Cited

U.S. PATENT DOCUMENTS

| | | | | |
|---|---|---|---|---|
| 4,858,130 | A | 8/1989 | Widrow | |
| 5,005,643 | A | 4/1991 | Soliman et al. | |
| 5,031,163 | A * | 7/1991 | Holzhausen | G01V 1/50 181/105 |
| 5,360,066 | A | 11/1994 | Venditto et al. | |
| 7,774,140 | B2 | 8/2010 | Craig | |
| 8,210,257 | B2 | 7/2012 | Dusterhoft et al. | |
| 8,404,727 | B2 | 3/2013 | Dhuppad et al. | |
| 8,733,444 | B2 | 5/2014 | East, Jr. et al. | |
| 10,428,626 | B2 * | 10/2019 | Durrani | E21B 43/00 |
| 10,753,181 | B2 | 8/2020 | Roussel | |
| 10,801,307 | B2 | 10/2020 | Roussel | |
| 11,209,558 | B2 | 12/2021 | Roussel | |
| 11,500,114 | B2 | 11/2022 | Roussel | |
| 2004/0129418 | A1 | 7/2004 | Jee et al. | |
| 2006/0102342 | A1 | 5/2006 | East et al. | |
| 2006/0155473 | A1 | 7/2006 | Soliman et al. | |
| 2007/0235181 | A1 | 10/2007 | Lecampion et al. | |
| 2010/0004906 | A1 | 1/2010 | Searles et al. | |
| 2010/0076738 | A1 | 3/2010 | Dean et al. | |
| 2010/0314104 | A1 | 12/2010 | Shokanov et al. | |
| 2011/0017458 | A1 | 1/2011 | East, Jr. et al. | |
| 2011/0067857 | A1 | 3/2011 | Underhill et al. | |
| 2011/0120712 | A1 | 5/2011 | Todd et al. | |
| 2011/0272147 | A1 | 11/2011 | Beasley et al. | |
| 2012/0152550 | A1 | 6/2012 | East, Jr. | |
| 2012/0325462 | A1 | 12/2012 | Roussel et al. | |
| 2013/0087325 | A1 | 4/2013 | Bartko et al. | |
| 2013/0090902 | A1 * | 4/2013 | Yao | E21B 43/26 703/2 |
| 2013/0186688 | A1 | 7/2013 | Rasmus et al. | |
| 2013/0211807 | A1 | 8/2013 | Templeton-Barrett et al. | |
| 2013/0277050 | A1 | 10/2013 | Cherian et al. | |
| 2013/0298665 | A1 | 11/2013 | Minchau | |
| 2014/0048270 | A1 | 2/2014 | Soliman et al. | |
| 2014/0067353 | A1 | 3/2014 | Shelley et al. | |
| 2014/0145716 | A1 | 5/2014 | Dirksen et al. | |
| 2015/0075775 | A1 | 3/2015 | Davidson et al. | |
| 2015/0176394 | A1 | 6/2015 | Roussel et al. | |
| 2016/0003020 | A1 | 1/2016 | Sharma | |
| 2016/0196367 | A1 | 7/2016 | Petukhov | |
| 2016/0357883 | A1 | 12/2016 | Weng et al. | |

FOREIGN PATENT DOCUMENTS

| | | | |
|---|---|---|---|
| WO | WO-2012173608 | A1 | 12/2012 |
| WO | WO-2013008195 | A3 | 3/2013 |
| WO | WO-2016175844 | A1 | 11/2016 |

OTHER PUBLICATIONS

East L., et al., "Methods for Enhancing Far-Field Complexity in Fracturing Operations," SPE Annual Technical conference and Exhibition, SPE 133380, Aug. 2011, vol. 26(3), 17 Pages.

Escobar F.H., et al., "Rate-Transient Analysis for Hydraulically Fractured Vertical Oil and Gas Wells," Asian Research Publishing Network (ARPN) Journal of Engineering and Applied Sciences, May 2014, vol. 9(5), pp. 739-749.

Far M.E., et al., "Interpretation of Factures and Stress Anisotropy in Marcellus Shale using multicomponents seismic data," Interpreatation, May 2014, vol. 2(2), pp. 105-115.

Gronseth J.M., "Determination of the Instantaneous Shut in Pressure From Hydraulic Fracturing Data and Its Reliability as a Measure of the Minimum Principal Stress," American Rock Mechanics Association, Aug. 1982, vol. 82(183), pp. 183-189.

Hayashi K., et al., Interpreatation of Hydraulic Fracturing Shut-in Curves for Tectonic Stress Measurements, International Journal of Rock Mechanics and Mining Sciences & Geomechanics Abstracts, Dec. 1989, vol. 26(6), pp. 477-482.

International Search Report and the Written Opinion for International Application No. PCT/US2017/063360 dated Feb. 15, 2018, 7 Pages.

International Search Report for International Application No. PCT/US2014/071217 dated Mar. 20, 2015, 3 Pages.

International Search Report for International Application No. PCT/US2017/63357 dated Feb. 15, 2018, 4 Pages.

Manchanda R., et al., "Factors Influencing Fracture Trajectories and Fracturing Pressure Data in a Horizontal Completion," 46th US Rock Mechanics/Geomechanics Symposium held in Chicago, Illinois, ARMA 12-633, Jun. 2012, 14 Pages.

Manchanda R., et al., "Time Dependent Fracture Interference Effects in Pad Wells," SPE 164534 presented at the SPE Unconventional Resource Conference, The Woodlands, Texas, Nov. 2014, vol. 29(4), 22 Pages.

McClure M.W., e al., "Computational Investigation of Trends in Initial Shut-in Pressure during Multi-Stage Hydraulic Stimulation in the Barnett Shale," 47th US Rock Mechanics/Geomechanics Symposium held in San Francisco, California, Jun. 2013, 15 Pages.

McLennan J.D., et al., "How Instantaneous are Instantaneous Shut-In Pressures?," Society of Petroleum Engineers of AIME, Sep. 1982, 25 Pages.

Nolte K.G., "Determination of Fracture Parameters from Fracturing Pressure Decline," Society of Petroleum Engineers of AIME, SPE Paper 8341, Sep. 1979, pp. 1-16.

Paderin G.V., et al., Multi-stage Hydro-fracture Trajectories: Modelling by the SIE Method, Procedia Materials Science, 2014, vol. 3, pp. 1798-1803.

Rafiee M., et al., "Hydraulic Fracturing Design and Optimization: A Modification to Zipper Frack," SPE Eastern Regional Meeting, SPE 159786, Oct. 2012, 16 Pages.

Roussel N.P., at al., "Implications of Fracturing Pressure Data Recorded during a Horizontal Completion on Stage Spacing Design," SPE 152631 presented at the SPE Hydraulic Fracturing Technology Conference, The Woodlands, Texas, Feb. 2012, 14 Pages.

Roussel N.P., et al., "Optimizing Fracture Spacing and Sequencing in Horizontal-Well Fracturing," SPE International Symposium and Exhibition on Formation Damage Control, SPE 127986, May 2011, vol. 26(2), 12 Pages.

Roussel N.P., et al., "Strategies to Minimize Frac Spacing and Stimulate Natural Fractures in Horizontal Completions," SPE 146104 presented at the SPE Annual Technical Conference and Exhibition, Denver, Colorado, Oct. 2011, 17 Pages.

Sneddon I.N., et al., "The Distribution of Stress in the Neighborhood of a Crack in an Elastic Solid," Proceedings of the Royal Society of London, Oct. 1946, vol. 187(1009), 32 Pages.

Soliman M.Y., et al., "Geomechanics Aspects of Multiple Fracturing of Horizontal and Vertical Wells," SPE Drilling and Completions, Sep. 2008, vol. 23(3), pp. 217-228.

Song J.H., et al., "Preventing Mud Losses by Wellbore Strengthening," SPE Russian Oil and Gas Technical Conference and Exhibition, Oct. 2006, 3 Pages.

Vermylen J.P., et al., "Hydraulic Fracturing, Microseismic Magnitudes, and Stress Evolution in the Barnett Shale, Texas, USA," SPE 140507 presented at the SPE Hydraulic Fracturing Technology Conference, The Woodlands, Texas, Jan. 2011, 15 Pages.

Waters G.A., et al., "Simultaneous Hydraulic Fracturing of Adjacent Horizontal Wells in the Woodford Shale," Hydraulic Fracturing Technology Conference, SPE 119635, Jan. 2009, 22 Pages.

* cited by examiner

METHOD FOR DETERMINING HYDRAULIC FRACTURE ORIENTATION AND DIMENSION

CROSS-REFERENCE TO RELATED APPLICATIONS

This application is a continuation application which claims benefit under 35 USC § 121 to U.S. Non-Provisional application Ser. No. 17/191,280 filed Mar. 3, 2021 which is continuation of U.S. Non-Provisional application Ser. No. 15/924,783 filed Mar. 19, 2018 which is a divisional of U.S. Non-Provisional application Ser. No. 14/575,176 filed Dec. 18, 2014, which claims priority to U.S. Provisional Application Ser. No. 61/917,659 filed Dec. 18, 2013, all entitled "METHOD FOR DETERMINING HYDRAULIC FRACTURE ORIENTATION AND DIMENSION," the contents of which are incorporated by reference herein in their entireties.

FIELD OF THE INVENTION

The present invention relates generally to hydraulic fracturing. More particularly, but not by way of limitation, embodiments of the present invention include tools and methods for determining hydraulic fracture orientation and dimensions using downhole pressure sensors.

BACKGROUND OF THE INVENTION

Hydraulic fracturing is an economically important stimulation technique applied to reservoirs to increase oil and gas production. During hydraulic fracturing stimulation process, highly pressurized fluids are injected into a reservoir rock. Fractures are created when the pressurized fluids overcome the breaking strength of the rock (i.e., fluid pressure exceeds in-situ stress). These induced fractures and fracture systems (network of fractures) can act as pathways through which oil and natural gas migrate en route to a borehole and eventually brought up to surface. Efficiently and accurately characterizing created fracture systems is important to more fully realize the economic benefits of hydraulic fracturing. Determination and evaluation of hydraulic fracture geometry can influence field development practices in a number of important ways such as, but not limited to, well spacing/placement design, infill well drilling and timing, and completion design.

More recently, fracturing of shale from horizontal wells to produce gas has become increasingly important. Horizontal wellbore may be formed to reach desired regions of a formation not readily accessible. When hydraulically fracturing horizontal wells, multiple stages (in some cases dozens of stages) of fracturing can occur in a single well. These fracture stages are implemented in a single well bore to increase production levels and provide effective drainage. In many cases, there can also be multiple wells per location.

There are several conventional techniques (e.g., microseismic imaging) for characterizing geometry, location, and complexity of hydraulic fractures out in the field. As an indirect method, microseismic imaging technique can suffer from a number of issues which limit its effectiveness. While microseismic imaging can capture shear failure of natural fractures activated during well stimulation, it is typically less effective at capturing tensile opening of hydraulic fractures itself. Moreover, there is considerable debate on interpretations of microseismic events and how they relate to hydraulic fractures. Other conventional techniques include solving geometry of fractures as an inverse problem. This approach utilizes defined geometrical patterns and varies certain parameters until numerically-simulated production values matches field data. In practice, the multiplicity of parameters involved combined with idealized geometries can result in non-unique solutions.

BRIEF SUMMARY OF THE DISCLOSURE

The present invention relates generally to hydraulic fracturing. More particularly, but not by way of limitation, embodiments of the present invention include tools and methods for determining hydraulic fracture orientation and dimensions using downhole pressure sensors. The present invention can monitor evolution of reservoir stresses throughout lifetime of a field during hydraulic fracturing. Measuring and/or identifying favorable stress regimes can help maximize efficiency of multi-stage fracture treatments in shale plays.

One example of a method for characterizing a subterranean formation includes: placing a subterranean fluid into a well extending into at least a portion of the subterranean formation to induce one or more fractures; measuring pressure response via one or more pressure sensors installed in the subterranean formation; and determining a physical feature of the one or more fractures.

Another example includes: placing a fracturing fluid down a well of a subterranean formation at a rate sufficient to induce a fracture and a pressure response within the subterranean formation; measuring the pressure response via one or more pressure gauges installed in selected locations within the subterranean formation; and determining a physical feature of the fracture.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figure 1:
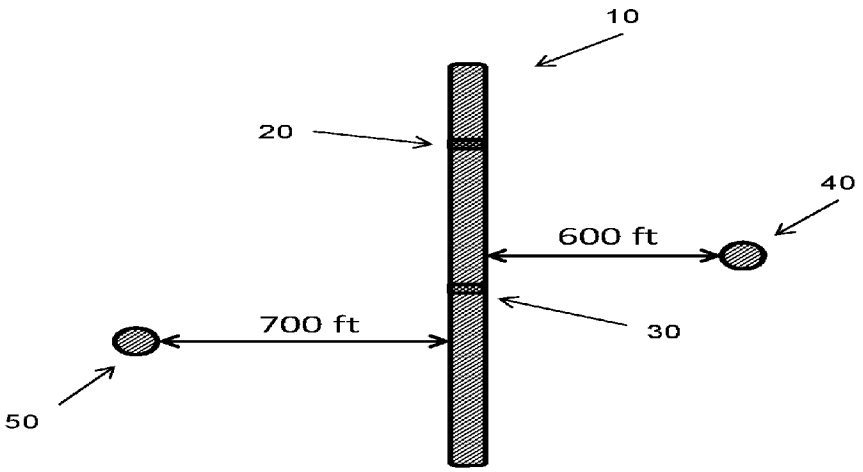
FIG. 1 show configuration of a reservoir monitored by pressure gauges.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

Recently, horizontal well developments in unconventional plays have increasingly utilized multiple downhole gauges to monitor pressure and temperature variations during both stimulation and production phase. For example, pressure variations may be observed by the monitor/offset wells during hydraulic fracturing operations during almost every stage. These pressure responses can range from just a couple psi to over a thousand psi. Modeling the geomechanical impact of a propagating fracture can demonstrate that almost all observed pressure responses do not represent a hydraulic communication between the fracture and the monitoring well. Instead a poroelastic response to the mechanical stress is introduced during the fracturing process.

When a stress load is applied to a fluid-filled porous material, the pressure inside the pores will increase in response to it (squeezing effect). The incremental pore pressure is then progressively dissipated until equilibrium is achieved. In a shale formation, diffusion can be so slow that excess pressure is maintained throughout the stimulation phase. As a result, the pressure response captured by the downhole gauges is directly proportional to stress perturbation induced by tensile deformation taking place during the propagation of a hydraulic fracture.

After building a geomechanical model of a propagating tensile fracture in a poro-linear-elastic material, we were able to match the pressure response of one fracturing stage and estimate the height, length, and orientation of the hydraulic fracture. At the end of stage, the downhole gauge features a pressure fall-off that represents the closing of the induced fracture, as the fracturing fluid leaks off into the formation. By simulating the leak-off process, we were able to calculate the effective permeability of the formation after it has been stimulated, often referred to as the SRV permeability. When applied to different field cases, this technology has been able to identify differences in height growth and stimulated permeability between a slickwater and a hybrid completion.

Poroelastic Response Analysis is showing tremendous potential in narrowing down the uncertainties of multi-stage fracture treatments in unconventional plays. Among its many advantages, it is based on simple well-established physical models (linear-poro-elasticity), it is much less sensitive to rock heterogeneities than pressure transient analysis, each stage can be matched separately, and the noise to signal ratio is small. Also, unlike microseismic which captures shear failure events in natural fractures, this technology directly measures the dilation of the actual hydraulic fracture.

The present invention provides tools and techniques for characterizing a subterranean formation subjected to stimulation. More specifically, the present invention evaluates dimensions and orientations of fractures induced during hydraulic fracturing using pressure response information gathered downhole in one or more wells (e.g., active, offset, monitoring). Length, height, vertical position, and orientation of hydraulic fractures can be evaluated by relating pressure variations measured downhole to actual fracture dilation. Use of multiple pressure sensors (in a single well or in multiple wells) allows fracture geometry to be triangulated during the entire propagation phase.

As opposed to some conventional methods (e.g., microseismic analysis), the present invention is a direct characterization of hydraulic fractures. The present invention may also be extensively implemented in multi-stage, multi-lateral horizontal wells and dramatically improve characterization of stimulated reservoirs. Such improvements could impact numerous aspects of production forecasting, reserve evaluation, field development, horizontal-well completions and the like. Uncertainty present in downhole pressure measurements are generally low and provide high signal to noise ratios. Other advantages will be apparent from the disclosure herein.

Pressure Monitoring During Hydraulic Fracturing

A subterranean formation undergoing stimulation (e.g., hydraulic fracturing) experiences stress and subsequently responds to that stress. In terms of pressure within the subterranean formation, a response can be the result of one or more of: interference mechanism (e.g., hydraulic communication, stress interference), perturbation (pressure, mechanical), measurement itself (direct or indirect), and the like. A careful analysis of pressure response can provide information about the fracture (e.g., length, orientation), fracture network (e.g., connectivity, lateral extent), and formation (e.g. native, stimulated permeability; natural fractures; stress anisotropy, heterogeneity).

As used herein, the term "poroelastic response" refers to a phenomenon resulting from an increased fluid pressure caused by, for example, an applied stress load ("squeezing effect") in a fluid-filled porous material. A poroelastic response differs from a hydraulic response, which results from a direct fluid pressure communication between the induced fracture and a downhole gauge. Typically, this applied stress load results in incremental increase in pore pressure, which is then progressively dissipated until equilibrium is reached ("drained response"). During hydraulic fracturing, squeezing effect is achieved when net fracturing pressure causes tensile dilation ("squeezing effect") in propagating fractures. However, in a typical shale formation, diffusion is negligible and excess pressure is maintained in pore(s) ("undrained response") throughout the stimulation phase.

At the end of stimulation, induced fractures progressively close as fracturing fluids leak-off into the formation, thus "un-squeezing" the rock. This in turn leads to a decrease in the downhole gauge poroelastic response. The rate of change in the poroelastic response depends on how fast fracturing fluid leaks off the induced fractures, which is directly related to the permeability of the stimulated rock located in the vicinity of the hydraulic fracture (often referred to as Stimulated Reservoir Volume or SRV). During hydraulic fracturing, poroelastic response can result from variations in tensile dilation both during hydraulic fracture propagation and closure.

Figure 2:
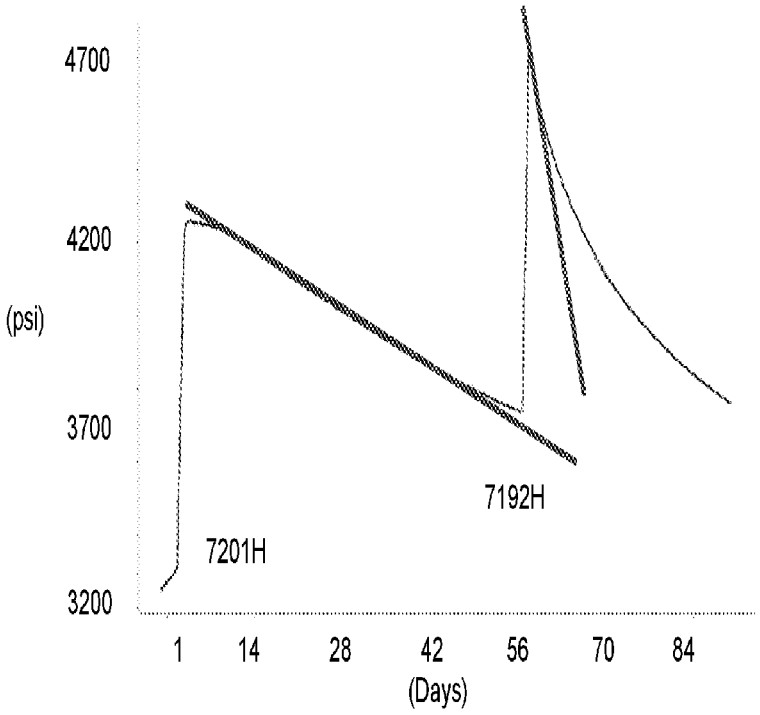
FIG. 2 (middle gauge) and FIG. 3 (bottom gauge) show poroelastic response of the reservoir in FIG. 1 subjected to net pressure inside tensile hydraulic fracture.
Figure 3:
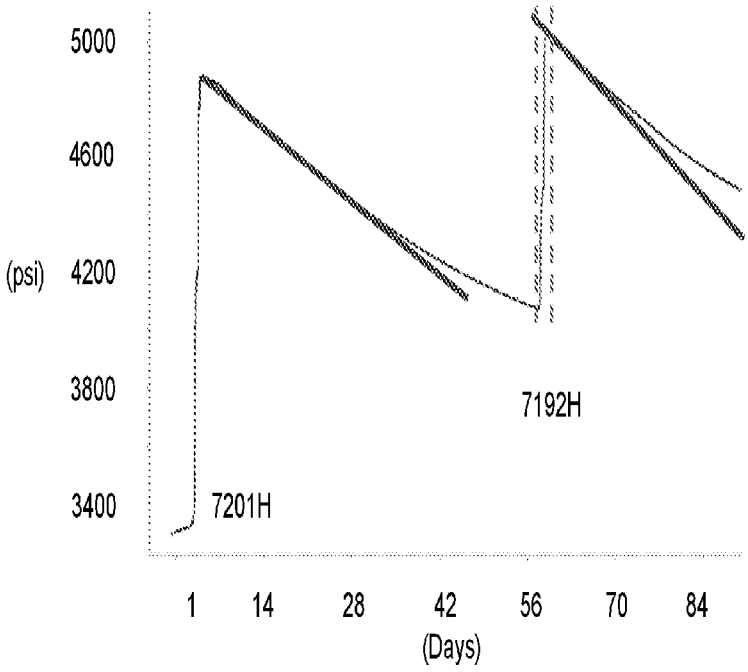

FIG. 1 illustrates a sample configuration of pressure sensors installed downhole. As shown, this setup features a monitor well 10 with two pressure gauges (middle gauge 20 and bottom gauge 30). The middle gauge 20 is located above a first fracture 40 ("7192H") is located approximately 600 feet laterally from the monitor well 10. The bottom gauge 30 is located below 7192H fracture but above fracture 50 ("7201H") which is located approximately 700 feet laterally from the monitor well 10. The poroelastic response as measured by the pressure gauges has been plotted versus time in FIGS. 2 (middle gauge) and 3 (bottom gauge). Sharp vertical spikes (e.g., line between dotted lines in FIG. 3)

shown in FIGS. 2 and 3 is largely due to tensile fracture dilation caused by a net pressure increase when fracturing fluid is introduced. Pressure relaxation (e.g., signal portion after the dotted lines in FIG. 3) is largely due to fracture closure resulting from fluid leaking off into stimulated reservoir. Typically, a small-scale poroelastic response ranges from several psi's to several hundred psi's although pressure changes above 1000 psi's can be observed. A poroelastic response can propagate and be detected by pressure sensors located thousands of feet away from the propagating fracture. By analyzing pressure data, propagation as well as characteristics (e.g., length, height, orientation) of a hydraulic fracture can be tracked during each stage of a fracturing process.

Poroelastic response analysis can be aided by a coupled hydraulic fracturing and geomechanics model used to synthetically recreate the poroelastic response to the mechanical stress perturbation caused by displacement of fracture walls (dilation) during hydraulic fracture propagation. When a stress load is applied to a fluid-filled porous material, the pressure inside the pores will increase in response to it ("squeezing effect"). Incremental pore pressure is then progressively dissipated until equilibrium is reached. In shale formations, diffusion is typically so slow such that excess pressure is maintained throughout the stimulation phase. As a result, pressure response captured by downhole pressure sensors is directly proportional to stress perturbation induced by tensile deformation taking place during propagation of a hydraulic fracture. The pressure signal detected by downhole pressure sensors may be synthetically calculated using a numerical model. An example of a suitable numerical model utilizes Symmetric Galerkin Boundary Element Method (SGBEM) and also applies Finite Element Method (FEM) in order to simulate stress interference (including poroelastic response) induced by hydraulic fracture propagation. The SBGEM is used to model fully three-dimensional hydraulic fractures that interact with complex stress fields. The resulting three-dimensional hydraulic fractures can be non-planar surfaces and may be gridded and inserted inside a bounded volume to allow the application of FEM calculations.

Once geometry information has been determined, it can then be entered as input in a reservoir simulator for, among several things, production forecasting, reservoir evaluation, and the like. The geometry information can also influence field development practices such as, but not limited to, well spacing design, infill well drilling, and completion design.

At time-step levels, local aperture predicted by the hydraulic fracture simulation can be applied as a boundary condition for the FEM to calculate a perturbed stress field around a dilated fracture. The poroelastic response to the propagation of the hydraulic fracture can then be monitored at specific points of the reservoir, corresponding to location of pressure sensors installed in offset/monitor wells. Numerical models may be used to generate type-curves that can be used to interpret the pressure signal from downhole pressure sensors using graphical methods similar Pressure Transient Analysis. Alternatively or additionally, the measured pressure signals may also be matched to the model by varying its input parameters.

The following examples of certain embodiments of the invention are given. Each example is provided by way of explanation of the invention, one of many embodiments of the invention, and the following examples should not be read to limit, or define, the scope of the invention.

Example 1

In this Example, pressure gauges were installed downhole and monitored during multi-stage hydraulic fracturing of horizontal wells in a shale formation located in Eagle Ford Formation located near San Antonio, Tex.

Figure 4:
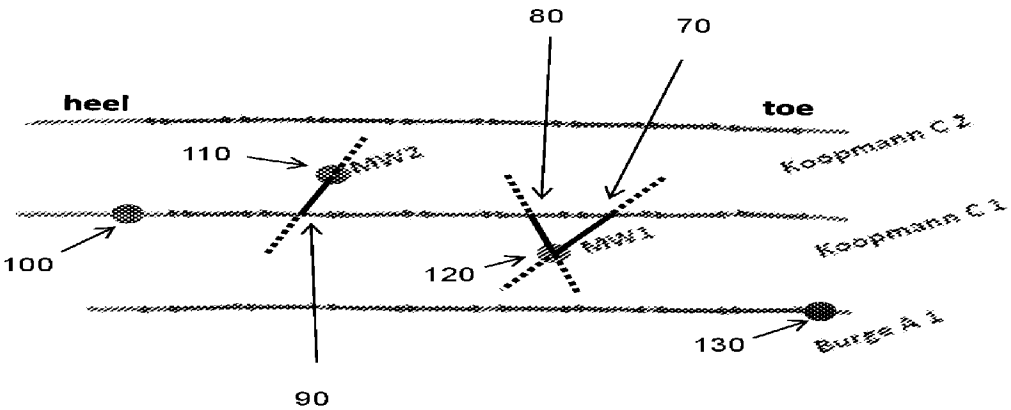
FIG. 4 illustrates configuration of downhole wells as described in Example 1.

FIG. 4 shows a configuration of active (Koopmann C1) and offset (Burge A1, Koopman C2) wells and monitoring wells (MW1, MW2) used in this Example. Pressure gauges (100, 110, 120, 130) were installed in two of the wells (Koopmann C1 and Burge A1) as well as both monitoring wells (MW1 and MW2). Initial stages of the multi-stage hydraulic fracturing process start at toe end of the horizontal wells while each subsequent fracturing stage starts closer and closer to heel end of the horizontal well. As illustrated, hydraulic communication between the monitoring wells and Koopmann C1 is present during various fracturing stages 70, 80, and 90.

Figure 5:
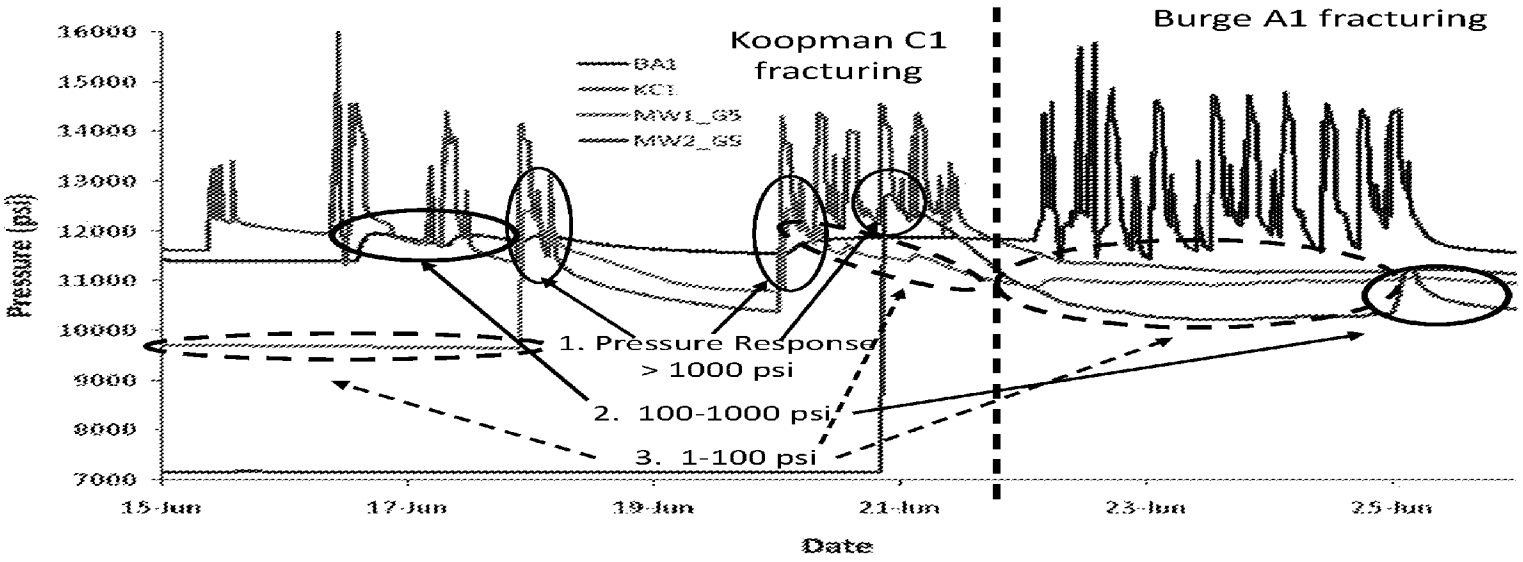
FIG. 5 plots pressure response in the fractures and monitor wells of FIG. 4.

FIG. 5 plots pressure response recorded by the pressure gauges as a function of time. Koopmann C1 and Burge A1 were subjected to multiple fracturing stages. Dotted line in FIG. 5 clearly denotes a time when Koopman C1 fracturing has ended and just prior to when Burge A1 fracturing began. Referring to FIG. 5, the large pressure signals in the monitor wells (MW1 and MW2) mirror the large pressure changes in the active well (Koopman C1) but not in the offset well (Burge A1). This confirmed that MW1 and MW2 were in hydraulic communication These pressure responses are on the order −1000 psi or greater (vertically-oriented ellipticals in FIG. 5).

Figure 6:
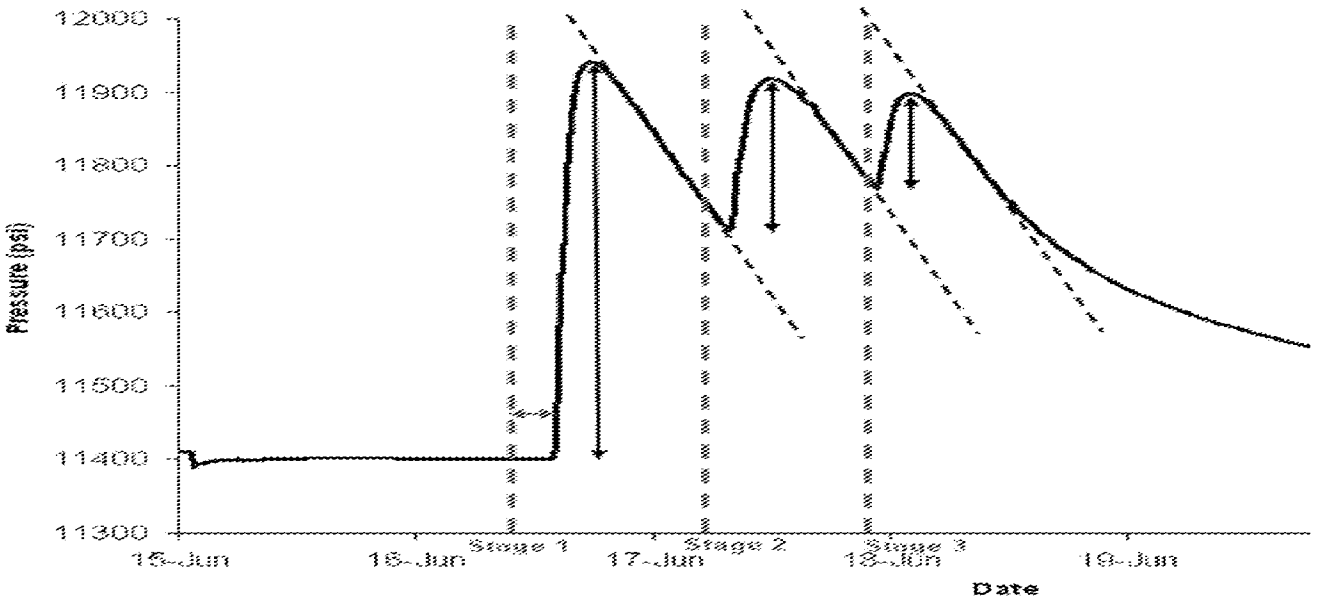
FIG. 6 is a close-up view of FIG. 5 as described in Example 1.
Figure 7:
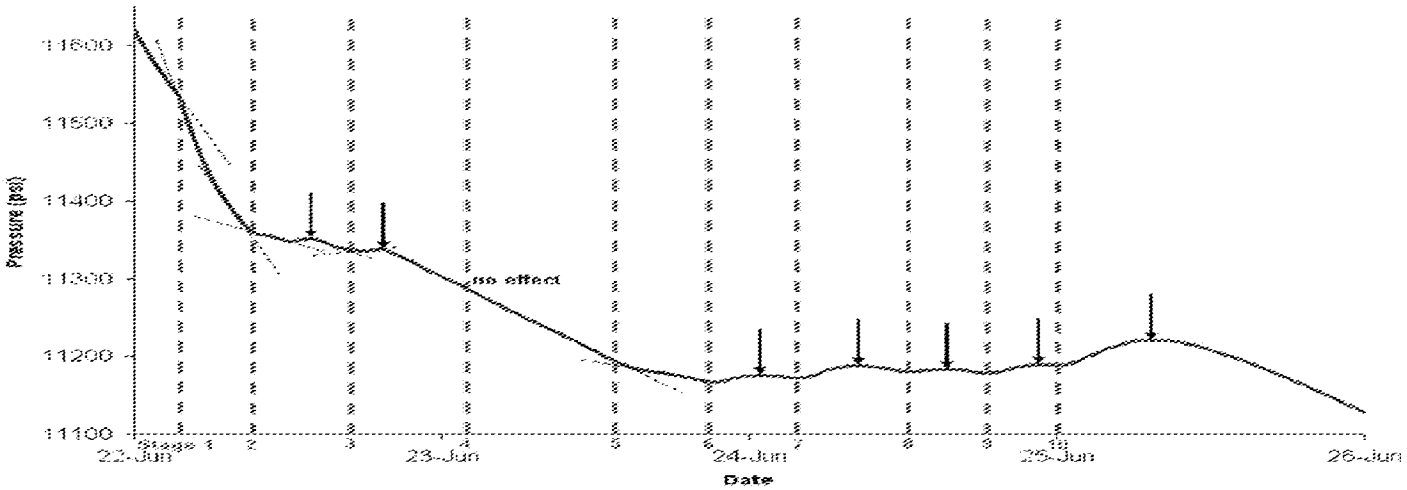
FIG. 7 is a close-up view of FIG. 5 as described in Example 1.
Figure 8:
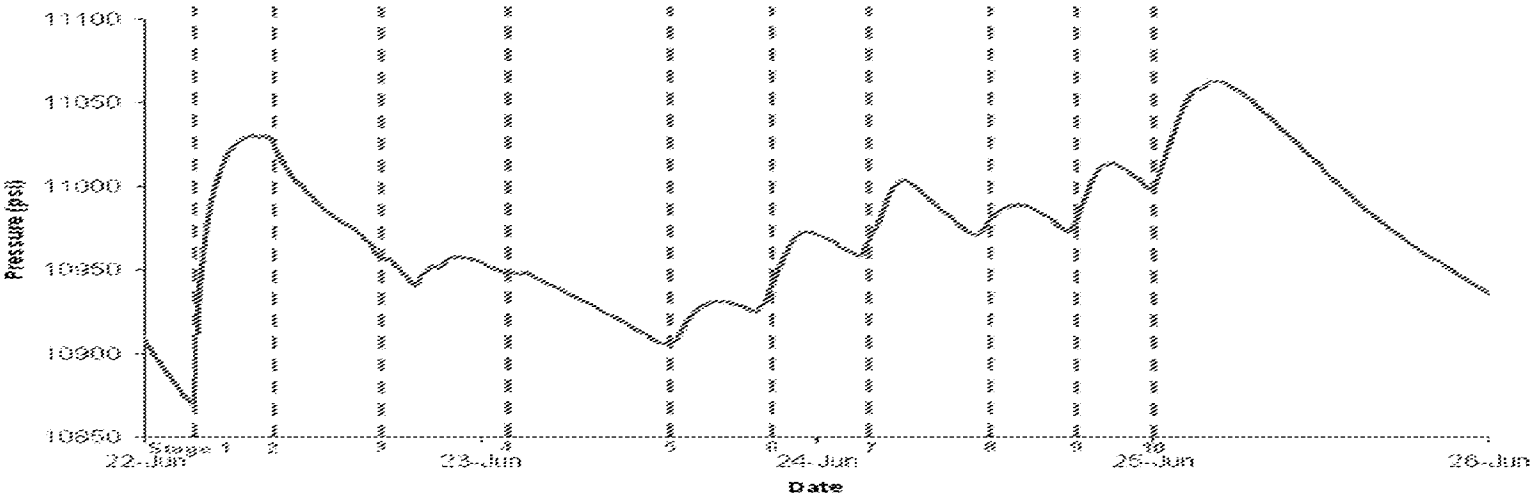
FIG. 8 is a close-up view of FIG. 5 as described in Example 1.
Figure 9:
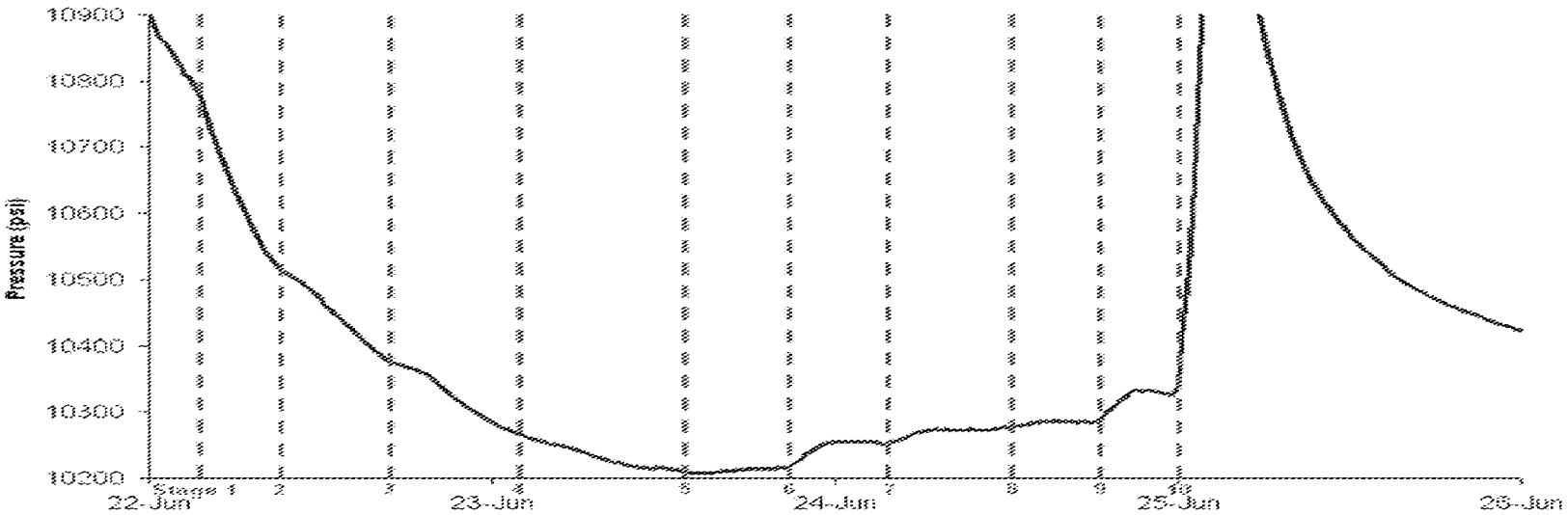
FIG. 9 is a close-up view of FIG. 5 as described in Example 1.
Figure 10:
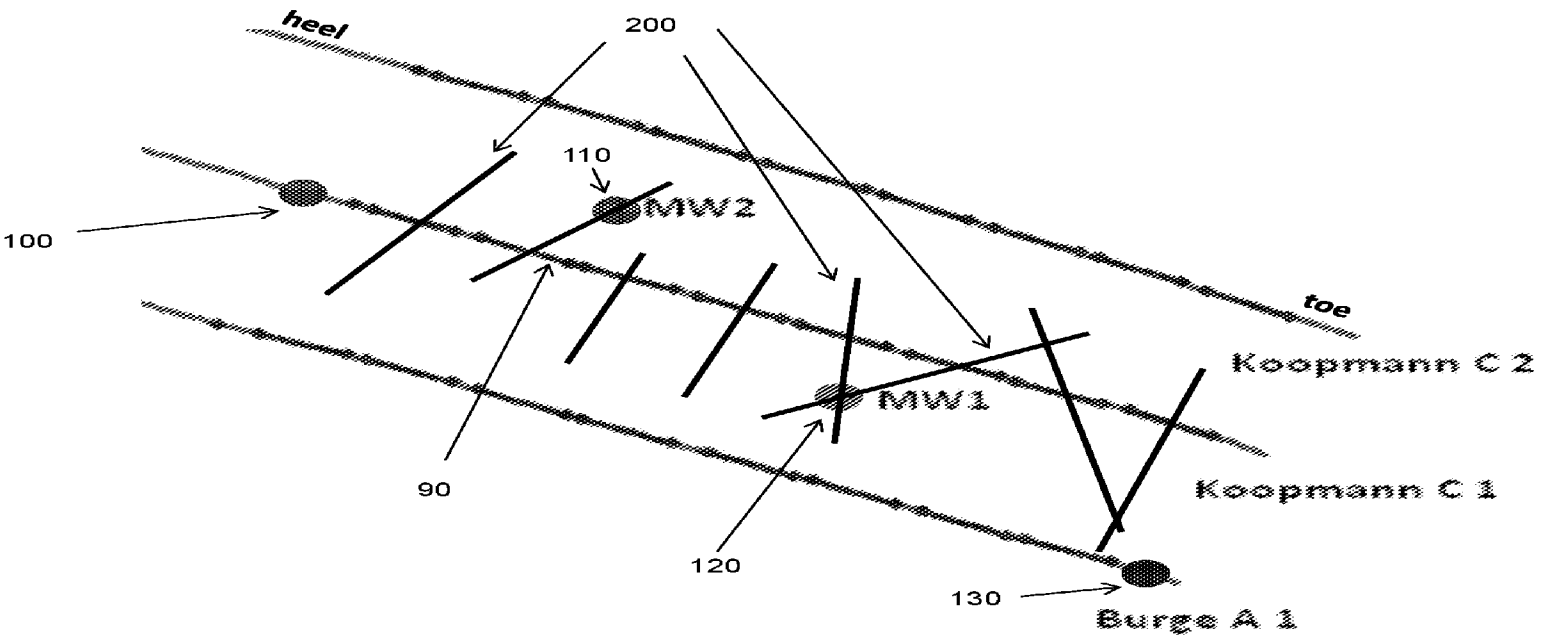
FIG. 10 illustrates configuration of downhole wells and fractures as described in Example 1.

With the exception of few instances of direct hydraulic communication, pressure signatures may be attributed to poroelastic response to mechanical perturbations induced during reservoir stimulation. As shown in FIGS. 5 and 6, pressure responses ranging from −100 to −1000 psi (horizontally-oriented ellipticals) were observed in Burge A1 and MW2 respectively. Referring to FIG. 6, there is a slightly delay in the pressure response following commencement of fracturing stage. It is believed that compressed fluid column in the Burge A1 offset well can leak-off back into the formation, thereby providing diagnostic information on formation permeability. As shown in FIG. 6, a rapid pressure increase was seen after the delay, followed by slower pressure decay after fracture injection. This pressure response is likely a poroelastic response to stress interference. There are at least two types of stress perturbations (poroelastic and mechanical) that can create stress interference which, in turn, induces poroelastic response. Typically, poroelastic response to mechanical perturbation is much larger (orders of magnitude) than its response to poroelastic perturbation. Poroelastic responses are generally characterized by short response time combined with small magnitude of pressure signal. The pressure response is observed following almost every fracturing stage regardless of treatment distance to monitor or offset well (i.e., non-localized phenomenon). Small pressure responses ranging from −1 to −100 psi can also be observed as shown in FIG. 7 (Koopman C1), FIG. 8 (MW1), and FIG. 9 (MW2). The dotted line in FIGS. 6-9 indicate start of each fracturing stage and correlate well with changes in small pressure response. FIG. 10 shows a revised configuration of active, offset, and monitoring wells with predicted fractures 200 based on the collected pressure response data.

Two methods were developed to calculate the fracture dimensions and orientations based on the measured poroelastic response. One methods called dynamic analysis, uses a geomechanical finite element code to simulation the dynamic evolution of the poroelastic response as the induced fracture propagates into the shale reservoir. Dyanamic analysis can analyze the whole pressure profile as captured by the downhole gauges in an offset well. The fracture properties are obtained as a typical inverse problem by matching the numerically simulated poroelastic response to the one measured in the field. Dynamic analysis allows improved, stage-by-stage, induced fracture characterization (e.g., fracture length, SRV permeability, multiple fracs/stage).

A second method, called static analysis, only uses the magnitude of the poroelastic response. An analytical model was developed (see equations) that express the static poroelastic response as a function of the relative position of the downhole gauge to the induced fracture. The inverse problem is then solved to find the combination of induced fracture height, orientation, and vertical position that matches the measured poroelastic responses.

Poroelastic response to changes in volumetric stress:

$$\Delta p_{poro} = B \times \Delta p_{poro} = \frac{B}{3}(\sigma_{xx} + \sigma_{yy} + \sigma_{zz}) \tag{1}$$

Figure 11:
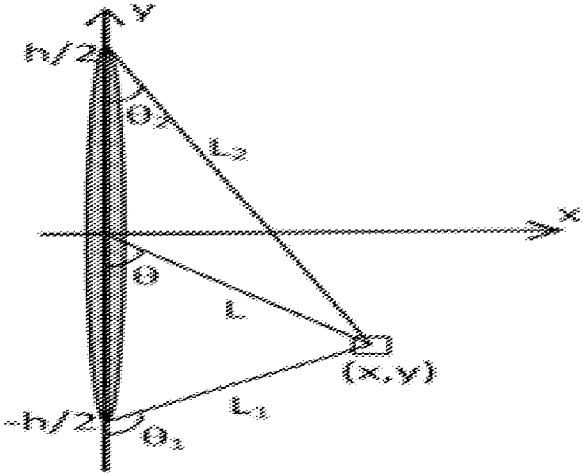
FIG. 11 illustrates a model as described in Example 1.

Referring to FIG. 11, stresses in the vicinity of a semi-infinite fracture for undrained deformations (Sneddon, 1946):

$$\sigma_{xx} + \sigma_{yy} = 2(p_f - \sigma_{hmin})\left[\frac{r}{\sqrt{r_1 r_2}}\cos(\theta - 0.5(\theta_1 + \theta_2)) - 1\right] \tag{2}$$

$$\sigma_{zz} = \nu_{undrained}(\sigma_{xx} + \sigma_{yy}) \tag{3}$$

The undrained Poisson's ratio can be expressed as a function of drained elastic and poroelastic properties:

$$\nu_{undrained} = \frac{3\nu + \alpha B(1 - 2\nu)}{3 - \alpha B(1 - 2\nu)} \tag{4}$$

The final expression for the poroelastic response to a dilated semi-infinite fracture is:

$$\Delta p_{poro} = \frac{2B(p_f - \sigma_{hmin})(1 + \nu)}{3 - \alpha B(1 - 2\nu)}\left[\frac{r}{\sqrt{r_1 r_2}}\cos(\theta - 0.5(\theta_1 + \theta_2)) - 1\right] \tag{5}$$

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. Sneddon, I. N. 1946. The Distribution of Stress in the Neighborhood of a Crack in an Elastic Solid. *Proceedings, Royal Society of London* A-187: 229-260.

What is claimed is:

1. A method for triangulating fracture geometries, comprising:

causing one or more fractures in a section of a subterranean formation;

determining a pressure response caused by change in volumetric stresses of the subterranean formation, wherein the pressure response is measured by pressure sensors that are in at least partial hydraulic isolation with the section of the subterranean formation; and determining a geometry associated with a stimulated reservoir volume of the one or more fractures using a model of a propagating fracture which relates the pressure response to a physical feature of the propagating fracture.

2. The method of claim 1, wherein the pressure sensors comprise a first sensor disposed in a first well and a second sensor disposed in a second well.

3. The method of claim 2, wherein determining the pressure response comprises:

detecting, using the first sensor, a first pressure change occurring over a first period of time; and detecting, using the second sensor, a second pressure change occurring over a second period of time subsequent to the first period of time.

4. The method of claim 3, wherein an end of the first pressure change occurs prior to a beginning of the second pressure change.

5. The method of claim 3, further comprising:

detecting a delay period between the first period of time and the second period of time; and determining, based at least in part on the delay period and the model, a permeability of the subterranean formation.

6. The method of claim 2, further comprising determining a rate of closure of the stimulated reservoir volume of the one or more fractures using the model.

7. A method for triangulating fracture geometries, comprising:

obtaining a model relating a poroelastic pressure response to at least one physical feature of a subterranean formation;

obtaining poroelastic pressure response information corresponding to one or more fractures induced in one or more portions of the subterranean formation, wherein the poroelastic pressure response information is measured by sensors that are in at least partial hydraulic isolation with the one or more portions of the subterranean formation; and determining a geometry associated with the one or more fractures using the poroelastic pressure response and the model.

8. The method of claim 7, wherein the sensors comprises a first sensor disposed in a first well and a second sensor disposed in a second well.

9. The method of claim 8, wherein obtaining the poroelastic pressure response information comprises:

detecting, using the first sensor, a first poroelastic pressure change occurring over a first period of time; and detecting, using the second sensor, a second poroelastic pressure change occurring over a second period of time subsequent to the first period of time.

10. The method of claim 9, wherein an end of the first poroelastic pressure change occurs prior to a beginning of the second poroelastic pressure change.

11. The method of claim 9, further comprising:

detecting a delay period between the first period of time and the second period of time; and determining, based at least in part on the delay period and the model, a permeability of the subterranean formation.

12. The method of claim 8, wherein the first well comprises an active well and the second well comprises an offset well.

13. The method of claim 7, wherein the sensors comprise:

a first downhole sensor disposed above the one or more fractures; and a second downhole sensor disposed below the one or more fractures.

14. A method for triangulating fracture geometries, comprising:

causing fracturing fluid to be placed down a well of a subterranean formation at a rate for inducing a fracture;

measuring a mechanical pressure response caused by a change in a volumetric stress of the subterranean formation using pressure sensors, wherein the pressure sensors are in at least partial hydraulic isolation with a section of the well that is being fractured; and determining a geometry associated with the fracture using a model of a propagating fracture which relates the mechanical pressure response to a physical feature of the fracture.

15. The method of claim 14, wherein:

the well comprises a first well; and the pressure sensors comprise a first pressure sensor disposed in the first well and a second pressure sensor disposed in a second well.

16. The method of claim 15, wherein measuring the mechanical pressure response comprises:

detecting, using the first pressure sensor, a first mechanical pressure change occurring over a first period of time; and detecting, using the second pressure sensor, a second mechanical pressure change occurring over a second period of time subsequent to the first period of time.

17. The method of claim 16, wherein an end of the first mechanical pressure change occurs prior to a beginning of the second mechanical pressure change.

18. The method of claim 16, further comprising:

detecting a delay period between the first period of time and the second period of time; and determining, based at least in part on the delay period and the model, a permeability of the subterranean formation.

19. The method of claim 14, further comprising monitoring closure of the fracture using the model.

20. The method of claim 14, wherein the pressure sensors comprise:

a first downhole pressure sensor disposed above the fracture; and a second downhole pressure sensor disposed below the fracture.

* * * * *